United States Patent [19]

Lamare

[11] Patent Number: 4,505,211

[45] Date of Patent: Mar. 19, 1985

[54] METHOD FOR DRYING AQUEOUS, SOLID FUELS

[75] Inventor: Charles-Louis V. Lamare, Norrköping, Sweden

[73] Assignee: A. Ahlstrom Osakeyhtio, Noormarkku, Finland

[21] Appl. No.: 375,756

[22] Filed: May 5, 1982

[30] Foreign Application Priority Data

Jun. 25, 1981 [FI] Finland ..... 811985

[51] Int. Cl.[3] ..... F23G 5/02

[52] U.S. Cl. ..... 110/346; 110/221; 110/224; 34/10; 34/35; 34/86; 165/104.31

[58] Field of Search ..... 110/347, 221, 224, 238, 110/232, 346; 165/104.31, DIG. 12; 34/57 R, 86, 35, 10

[56] References Cited

U.S. PATENT DOCUMENTS

| | | | |
|---|---|---|---|
| 1,833,130 | 11/1931 | Roe | 110/263 |
| 3,623,549 | 11/1971 | Smith, Jr. | 165/DIG. 12 |
| 4,330,411 | 5/1982 | Florin et al. | 110/346 |

*Primary Examiner*—Larry I. Schwartz

*Attorney, Agent, or Firm*—Bucknam and Archer

[57] ABSTRACT

Method for drying aqueous solid fuels, in which method the fuel is heated indirectly in a dryer by means of a heating medium heated in a boiler plant or the like and in which the steam formed in the dryer serves as a heating and transport medium. Oil or some other liquid having a boiling point higher than water is used as the indirect heating medium. Preferably oil is heated in the boiler plant up to the temperature of 300° to 400° C. at a 1 bar pressure. Heat surfaces of a lamella heat exchanger suitably serves as the heat transfer surfaces of the dryer.

7 Claims, 1 Drawing Figure

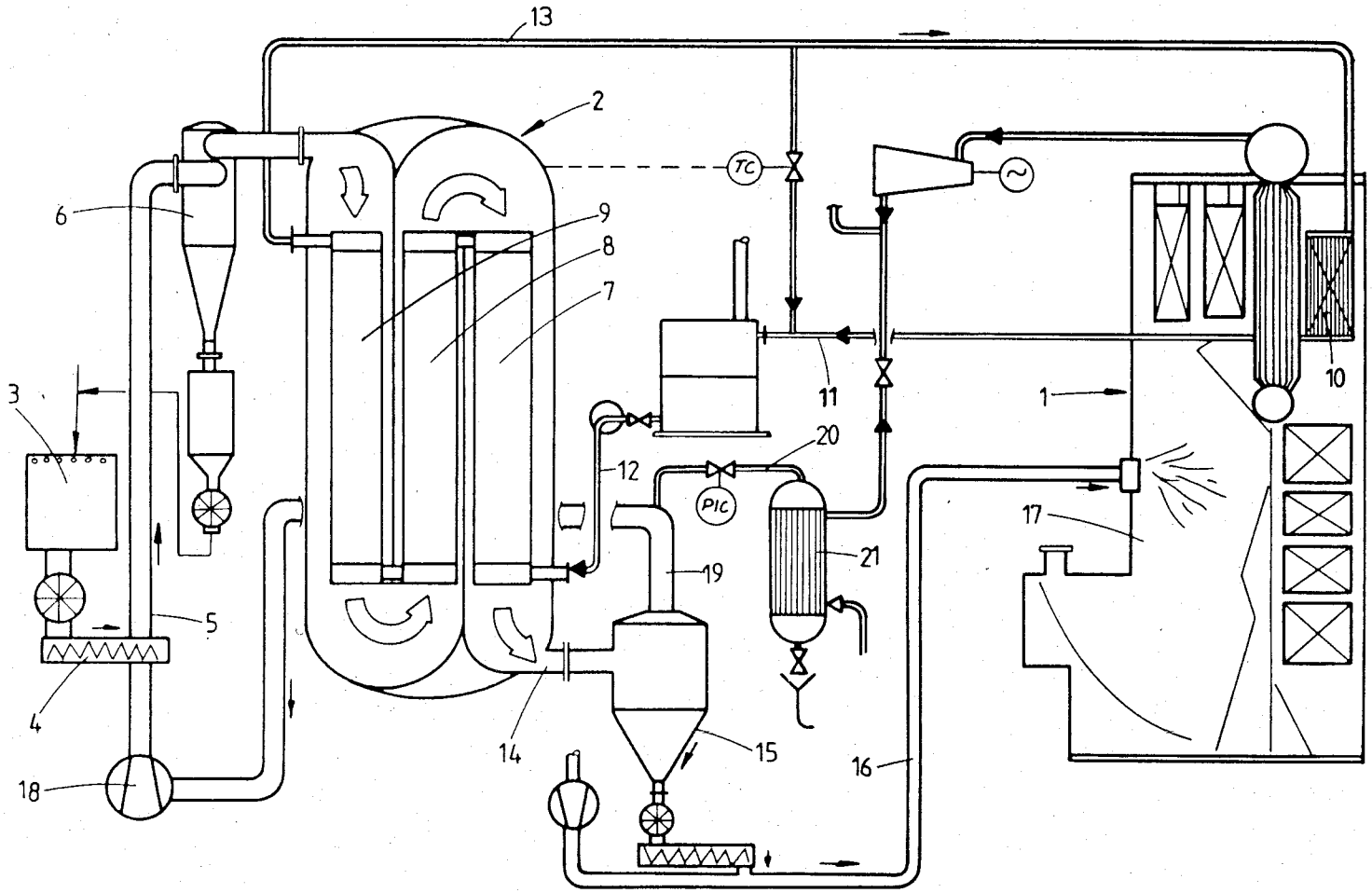
1
2
3
4
5
6
7
8
9
10
11
12
13
14
15
16
17
18
19
20
21
TC
PIC

METHOD FOR DRYING AQUEOUS, SOLID FUELS

The present invention is related to a method for drying aqueous, solid fuels, especially for drying bark, peat or other wood-based fuels, in which method the fuel is heated indirectly in a dryer by means of a heating medium which has been heated in a boiler plant or the like and in which the aqueous steam formed in the dryer is used as a heating and transport medium. The heating medium is preferably heated in the boiler plant in which the dried fuel will be burned.

The Swedish patent application No. 78 10 558 discloses a method for indirect drying of solid fuels in which steam formed in a steam boiler is used as an indirectly heating medium. As the pressure of steam used for indirect heating has to be high, e.g. 10 bar, so that the size of heat transfer surfaces would be within reasonable limits, only a tubular heat exchanger can be used in practical applications for heat transfer.

It is an object of the present invention to provide a method which enables the utilization of higher temperatures and lower pressures of the heating mediums, and thus the use of smaller and more inexpensive heat exchangers the known method.

This is accomplished, according to the invention, so that oil or some other liquid, the boiling point of which is higher than that of water, is used as the heating medium, e.g. eutectic liquids or high temperature salts, e.g. Na and K. Thereby high temperatures, e.g. 300°–400° C., can be used without having the effect that the pressure affecting the heat transfer surfaces is higher than the pressure required for compensating the flow resistances. This also enables the fact that inexpensive plate-type heat exchangers can be used which endure only small internal pressures, for example such as manufactured according to the methods disclosed by U.S. Pat. Nos. 3,512,239 or 3,336,783. In comparison with the method presented in the Swedish patent application, the method according to the invention provides the following advantages:

- a big temperature difference between the heating medium and the material to be dried
- inexpensive heat transfer surfaces
- small-sized apparatus
- efficient and rapid control of the process
- low operating and maintenance costs
- low initial costs
- the leakage risk of the heating medium is minimal The invention is further described in the following with reference to the accompanying drawing which is a schematic view of an embodiment applying the method in accordance with the invention.

The reference numeral 1 refers to a steam boiler where a fuel dried in a dryer 2 is combusted. Aqueous fuel, such as peat, the dry matter content of which is 50% is fed through a refiner 3, a screw feeder 4, a transfer pipe 5 and a cyclone separator 6 to the dryer 2. In the cyclone 6 the coarse material is separated and returned to the refiner. The finely-ground fuel to be dried is conveyed outside heat exchange lamellae 7, 8 and 9 and the heating medium, oil, inside them.

The oil is heated in a heat exchanger 10 disposed in the flue gas channel and conveyed through pipes 11 and 12 to the lower part of the heat exchange lamella 7. After it has flown through the lamella 7, oil is removed from the upper part of it and conveyed further through the other lamellae. The oil discharged from the last lamella 9, the temperature of which has decreased as it has transferred heat to the dried fuel, is returned through a pipe 13 of the heat exchanger 10 disposed in the steam boiler to be reheated.

The steam formed in the dryer 2 and the dried fuel are led through a pipe 14 to a cyclone separator 15 in which steam is separated from the fuel which is fed to a combustion chamber 17 through a pipe 16. The steam is circulated by means of a blowing fan 18 in a circulation system formed by a steam discharge pipe 19 of the cyclone, the transfer pipe 5, the dryer 2 and the cyclone separator 15. In this circulation system steam serves both as the heating and the transport medium. The excess steam formed in the drying of the fuel is removed through a pipe 20 to a heat exchanger 21.

In the following, the size of the heating surface required for drying the fuel is calculated first for drying according to the method of the invention and secondly, for drying according to the known method.

| Example | Method according to the invention | Method according to SE 7810558 |
|---|---|---|
| Temperature of the indirect heating medium | 320→250° C. (1 bar) | 183° C. (10 bar) |
| Temperature of the steam formed in the drying | 143° C. (4 bar) | 143 ° C. (4 bar) |
| Heating surface area needed for the evaporation of water, provided that the initial temp. is 100° C. | 96 $m^2$/ton | 345 $m^2$/ton |

When applying the method according to the Swedish patent application No. 78 10558 tubular heat exchangers are the most suitable due to the high pressure of the heating medium. In the method according to the invention the pressure of the heating medium inside the heat exchangers is low, and normal lamellae can thus be used.

As the costs of the heating surface of a tubular heat exchanger are about double as much as the costs of the lamellae of the lamella heat exchangers, the method according to the present invention is by far the most economical.

The high temperature of the indirect heating medium enables a high pressure (e.g. 10 bar) and temperature outside the heat exchange lamellae, and thus also a big temperature difference between the material to be dried and the steam formed in the dryer. Due to this, efficient heat transfer is achieved in the material, whereby the size and the construction costs of the apparatus decrease.

The specific embodiment shown is not meant to limit the scope of the claims and the example given is noly one of several methods which can be employed.

We claim:

1. A method for drying aqueous solid fuels comprising the steps of:

heating said fuel indirectly in a dryer by means of a medium heated in a boiler or the like, said medium being a liquid having a boiling temperature higher than water; and using steam formed in said dryer by the evaporation of moisture from said fuels to both heat said fuel in said dryer and to pneumatically transport all of said fuel from said dryer.

2. A method according to claim 1, characterized in that oil is used as the indirect heating medium.

3. A method according to claim 1, characterized in that oil is heated up to a temperature of 300° to 400° C.

4. A method according to claim 3, characterized in that the heating of the oil is carried out at a pressure inside the heat exchanger which is lower than the pressure of said steam outside the heat exchanger.

5. A method according to claim 1, characterized in that the heating of the fuel is carried out at a pressure inside the heat exchanger which is lower than that of said steam outside the heat exchanger.

6. A method according to claim 1, characterized in that the heating surfaces of a lamellar heat exchanger serve as the heat transfer surfaces of the dryer.

7. The method of claim 1 further comprising conveying said steam formed in said dryer together with said fuel to a separator in which said steam is separated from the fuel and then conveying some of said separated steam back to said dryer.

* * * * *